US006626767B2

(12) United States Patent
Lawlyes

(10) Patent No.: US 6,626,767 B2
(45) Date of Patent: Sep. 30, 2003

(54) APPARATUS FOR GOLF PUTTING PRACTICE

(76) Inventor: Daniel A. Lawlyes, 3144 Woodfield Dr., Kokomo, IN (US) 46902-4788

( * ) Notice: Subject to any disclaimer, the term of this patent is extended or adjusted under 35 U.S.C. 154(b) by 0 days.

(21) Appl. No.: 10/179,782

(22) Filed: Jun. 25, 2002

(65) Prior Publication Data

US 2003/0130053 A1 Jul. 10, 2003

Related U.S. Application Data

(60) Provisional application No. 60/345,409, filed on Jan. 7, 2002.

(51) Int. Cl.[7] ..... A63B 69/36
(52) U.S. Cl. ..... 473/180
(58) Field of Search ..... 473/178, 180, 473/163

(56) References Cited

U.S. PATENT DOCUMENTS

| | | | | | |
|---|---|---|---|---|---|
| 3,572,720 | A | | 3/1971 | Berg | 273/176 |
| 4,783,075 | A | | 11/1988 | Simjian | 273/176 FA |
| 4,906,006 | A | | 3/1990 | Sigunick | 273/178 |
| 4,953,865 | A | | 9/1990 | Coombs | 273/176 F |
| 4,966,370 | A | | 10/1990 | Morris | 473/159 |
| 5,120,063 | A | * | 6/1992 | Birchler et al. | 473/180 |
| 5,275,405 | A | * | 1/1994 | Ridge | 473/180 |
| 5,505,451 | A | * | 4/1996 | Brayshaw | 473/163 |
| 5,586,941 | A | | 12/1996 | Klearman | 473/160 |
| 5,620,375 | A | * | 4/1997 | Frotten | 473/180 |
| 5,690,557 | A | | 11/1997 | Casillas | 473/265 |
| 5,725,438 | A | * | 3/1998 | Dennesen | 473/163 |
| 5,997,407 | A | * | 12/1999 | Alexandres | 473/180 |
| 6,193,613 | B1 | * | 2/2001 | Alexandres | 473/183 |

* cited by examiner

*Primary Examiner*—Mark S. Graham
(74) *Attorney, Agent, or Firm*—Frank D. Lachenmaier

(57) ABSTRACT

The present invention discloses an apparatus for golf putting practice wherein the present invention is an insert having at least one regulation size golf hole disposed therein wherein the insert is complementarily sized and shaped to be inserted into the outlet opening of a conventional heating and ventilation air conditioning (HVAC) system as might occur in the floor of a home or office building replacing a standard vent register. The insert is sized to be removably secured internal of the HVAC outlet so that it can be easily inserted and removed therefrom.

4 Claims, 3 Drawing Sheets

APPARATUS FOR GOLF PUTTING PRACTICE

CROSS-REFERENCE TO RELATED APPLICATION

This application claims the benefit of Provisional Patent Application Ser. No. 60/345,409 filed Jan. 7, 2002.

FEDERALLY SPONSERED RESEARCH

Not Applicable

SEQUENCE LISTING OR PROGRAM

Not Applicable

BACKGROUND

1. Field of Invention

This invention generally relates to golfing equipment and, more particularly, is concerned with an apparatus for golf putting practice.

2. Description of Prior Art

Golf putting practice devices have been described in the prior art. Many are large, bulky, and above ground level. As such, they-have a negative effect on the decor of the room in which they are installed and are removed when not in use. U.S. Pat. No. 4,783,075 to Simjian (1988) discloses an elongated mat that extends over an elevated frame to allow made and missed putts to be collected in catch basins. U.S. Pat. No. 5,586,941 to Klearman (1996) discloses a complex track which can be elevated to simulate putts of different lengths.

Many devices have complex swing restriction means to aid in training but do not duplicate the feel of alignment and stroke control required on an actual course. U.S. Pat. No. 5,690,557 to Casillas (1997) discloses a mat with tube insert rails to define a putting path; U.S. Pat. No. 4,953,865 to Coombs (1990) describes a matted plate with cut off golf tees defining a putting path; and U.S. Pat. No. 3,572,720 to Berg (1971) has an even more elaborate putting path alignment device of flexible flaps to constrain the putter movement.

The prior art devices do not replicate the sound and feel of a made putt when it drops into a regulation golf cup. The target cup or orifice is normally above floor level and consists of an orifice in a mat that is stretched over some type of retainer box as in Simjian or net as in Klearman. Some devices as in Berg and Coombs do not have a cup, but utilize a gravity return of the putted ball to the putter and U.S. Pat. No. 4,966,370 to Morris (1990) discloses a backstop that traps missed putts in a rail with latches. U.S. Pat. No. 4,906,006 to Sigunick discloses a set of shallow rings that if the ball is putted to hard it will jump out the other side.

SUMMARY

In accordance with the present invention an apparatus for golf putting practice comprises at least one United States Golf Association (USGA) sized golf cup disposed in an insert that replaces the conventional Heating and Ventilation Air Conditioning (HVAC) register. The insert is sized to be removably secured internal to the HVAC outlet so that it can be easily inserted and removed therefrom and the top surface is flush with the floor covering surface.

Objects and Advantages

Accordingly, several objects and advantages of the present invention are:

(a) to provide an apparatus for golf putting practice that is small, compact, and unobtrusive when installed in an office or home;

(b) to provide an apparatus for golf putting practice in which the golf cup is sized to meet United States Golf Association (USGA) regulations;

(c) to provide an apparatus for golf putting practice that disposes the golf cup below floor level;

(d) to provide an apparatus for golf putting practice which duplicates the unfettered nature of an actual putt;

(e) to provide an apparatus for golf putting practice that replicates the sound and feel of making a putt in a USGA regulation golf cup; and (f) to provide an apparatus for golf putting practice that utilizes the existing floor covering as the putting surface with no additional mats or tracks.

Still further objects and advantages will become apparent from a consideration of the ensuing description and drawings. In the description, reference is made to the accompanying drawings, which form a part hereof, and in which are shown, by way of illustration, specific embodiments in which the invention may be practiced. These embodiments will be described in sufficient detail to enable those skilled in the art to practice the invention, and be understood that other embodiments may be utilized and that structural changes may be made without departing from the scope of the invention. In the accompanying drawings, like reference characters designate the same or similar parts throughout the several views.

DRAWINGS

Drawing Figures

In the drawings, alternative embodiments are shown in figures that have the same numbers but different alphabetic suffixes.

REFERENCE NUMERALS IN DRAWINGS

Figure 1:
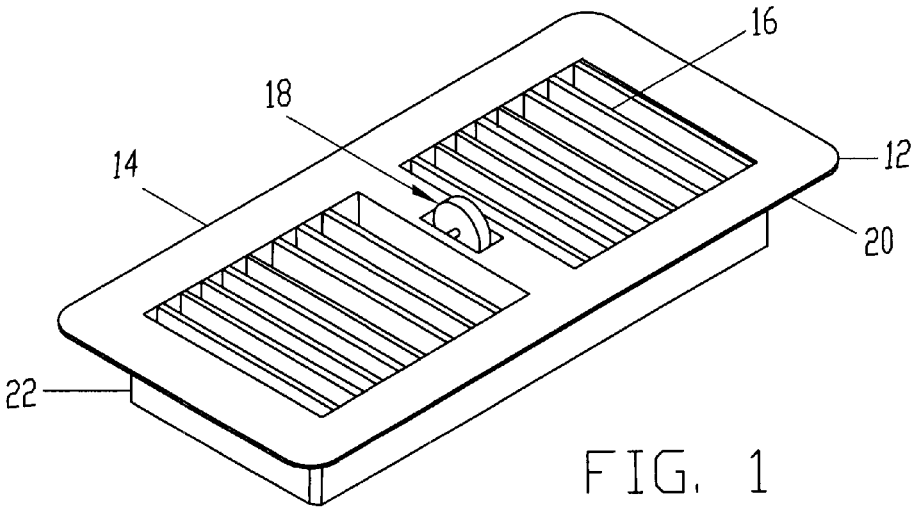
FIG. 1 PRIOR ART
FIG. 1 is a perspective view of a prior art standard HVAC register that the apparatus for golf putting practice replaces.

10 apparatus for golf putting practice
12 vent register
14 housing
16 movable vane
18 vane control means
20 flange
22 lower
24 upper surface
26 golf cup
28 lower wall
30 bottom of golf cup
32 aperture
34 cup wall
36 simulated hazard
38 plastic pin with flag
40 stationary vane
42 flag mounting boss
44 second golf cup

DETAILED DESCRIPTION

In order that the invention may be more fully understood, it will now be described, by way of example, with reference to the accompanying drawings in which FIGS. 1 through 5 illustrate a preferred embodiment of the present invention wherein an apparatus for golf putting practice is disclosed and FIGS. 3A and 3B disclose alternate embodiments.

Turning to FIG. 1, therein is shown a prior art Heating and Ventilation Air Conditioning (HVAC) vent register 12 having a housing 14 containing a plurality of movable vanes 16 and a vane control means 18 as would be provided in the standard manner by one skilled in the art. It should be noted that the vent register 12 has a flange 20 for contacting a floor surface of a room (not shown) along with a lower extended wall 22 of the housing 14 which connects in the standard manner to an under floor outlet (not shown) of a HVAC system of a building in which the HVAC system is installed.

Figure 2:
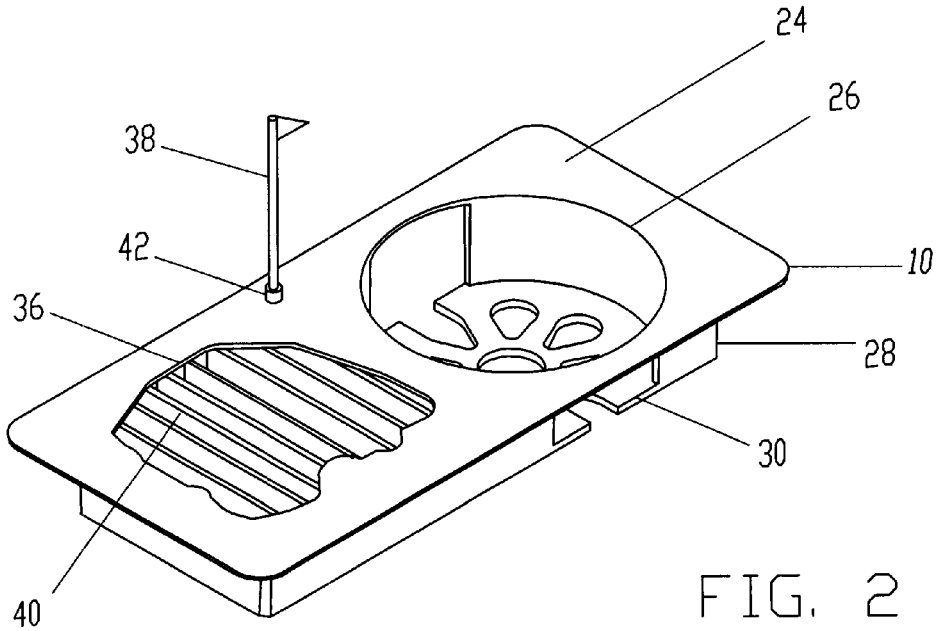
FIG. 2 is a perspective view of a single cup version of the apparatus for golf putting practice.

Turning to FIG. 2, therein is shown the apparatus for golf putting practice 10 which is complementarily sized and shaped as vent register 12 as shown in FIG. 1. The apparatus for golf putting practice 10 has an upper surface 24 which is sized to conform to or mate to the floor level of the room (not shown) in which the HVAC system is installed and is typically 290 mm long by 140 mm wide. The apparatus for golf putting practice 10 also has therein at least one golf cup 26 which is regulation sized as specified by the United States Golf Association (USGA) depending approximately 38 mm from the upper surface 24. The apparatus for golf putting practice 10 also has a lower wall 28, also depending from the upper surface 24 roughly 38 mm which supports the bottom of the golf cup 30, and which connects in the standard manner to an under floor outlet (not shown) of an HVAC system. The apparatus for golf putting practice 10 also has on the upper surface 24 a simulated hazard 36 formed by an irregularly shaped opening in upper surface 24 adjacent to the golf cup 26 with a plurality of stationary vanes 40 running beneath the opening of the simulated hazard 36 transverse to the long axis of the upper surface 24 between the lower walls 28. The apparatus for golf putting practice 10 also has on upper surface 24 a flag mounting boss 42 in which a plastic pin and flag 38 may be inserted.

Figure 3:
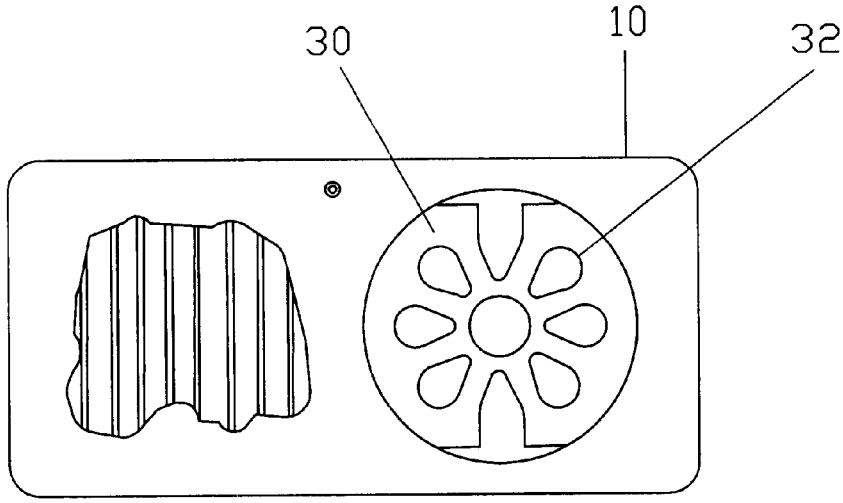
FIG. 3 is a plan view of the apparatus for golf putting practice.

Turning to FIG. 3, therein is shown the apparatus for golf putting practice 10 along with the elements previously disclosed and in addition thereto, disclosing the bottom of the golf cup 30 with a plurality of apertures 32 and the simulated hazard 36 through which air from the HVAC system may flow.

Figure 4:
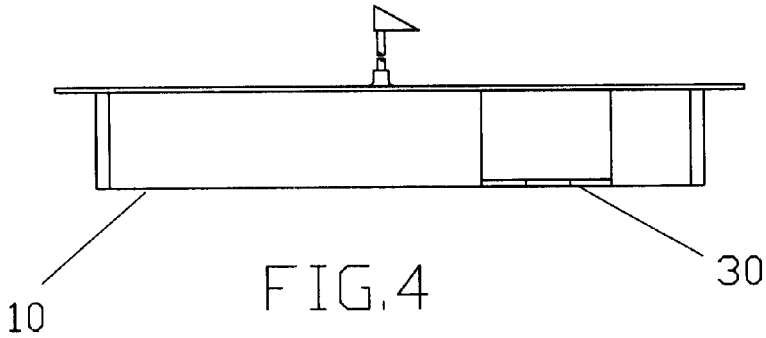
FIG. 4 is a front view of the apparatus for golf putting practice.

Turning to FIG. 4, therein is shown the apparatus for golf putting practice 10 along with the bottom of the golf cup 30 and lower wall 28 and other elements previously disclosed.

Figure 5:
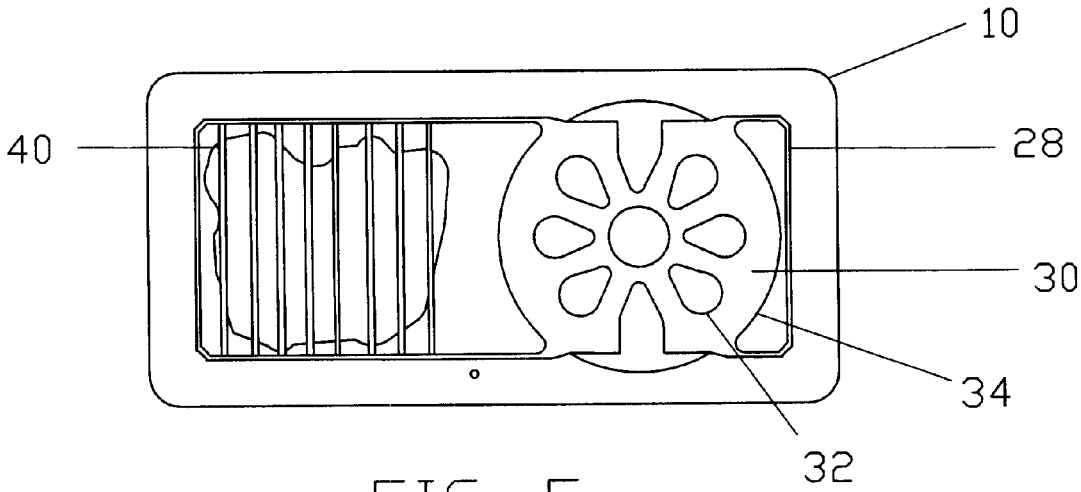
FIG. 5 is a bottom view of the apparatus for golf putting practice.

Turning to FIG. 5, therein is shown the apparatus for golf putting practice 10 along with a plurality of stationary vanes 40 attached perpendicularly between the lower walls 28 transverse to the long axis of the apparatus for golf practice 10 running beneath the simulated hazard 36. Also the cup wall 34 is shown which extends from the upper surface 24 to the bottom of the cup 30 at both ends of the cup 26 and from one side of lower wall 28 to the other side of lower wall 28 on circular arc with a radius of approximately 57 mm. The bottom of the cup 30 is shown having approximately a diameter of 114 mm with either side truncated at the cord created by the intersection of the diameter of the bottom of the cup 30 and the lower walls 28. The lower wall 28 which slips into the HVAC outlet (not shown) is sized to fit into a standard HVAC outlet and the corners are chamfered to reduce interferences with damaged HVAC outlets corners. Also the plurality of apertures 32 in the bottom of the cup 30 which allow air to flow through the apparatus for golf putting practice 10 and other elements previously disclosed are illustrated.

Figure 3A:
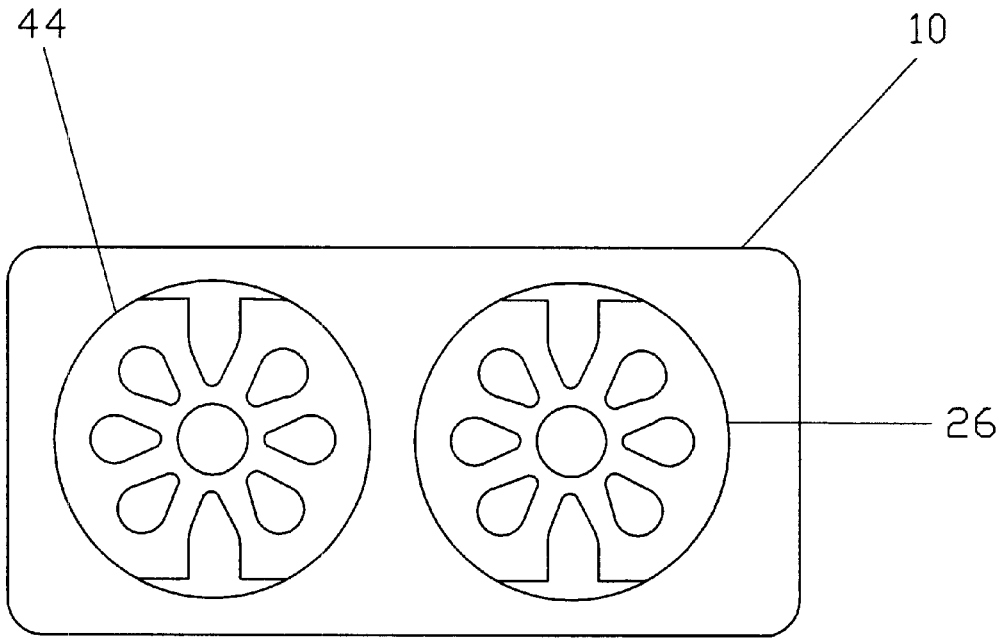
FIG. 3A is a plan view of a two cup embodiment of the apparatus for golf putting practice.

In FIG. 3A, therein is shown an alternative embodiment as in FIG. 3 except with the addition of a second golf cup 44 disposed adjacent to golf cup 26 in place of the simulated hazard 36 and the pin and flag 38 and the pin and flag mounting boss 42 are eliminated.

Figure 3B:
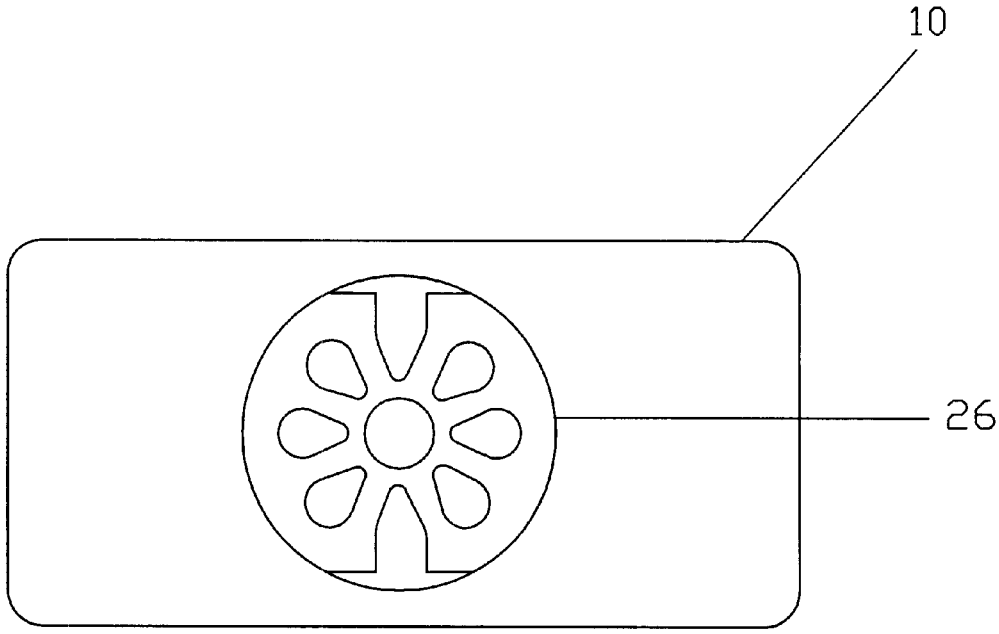
FIG. 3B is a plan view of a single centered cup embodiment of the apparatus for golf putting practice.

In FIG. 3B, therein is shown another alternate embodiment as in FIG. 3 except the opening in upper surface 24 for golf cup 26 is centered in the upper surface and the simulated hazard 36 and the pin and flag 38 and pin and flag mounting boss 42 are eliminated.

In the preferred embodiment of the apparatus for golf putting practice 10, the upper surface 24, the simulated hazard 36, a plurality of stationary vanes 40, the lower wall 28, the flag mounting boss 42, and the golf cup 26 are all molded in one integral shot of an injection grade thermoplastic material such as acetal. However the assembly could be molded of any plastic material that is injection grade, can withstand the fluctuating temperatures of a standard home heating and air conditioning duct, and that can be green in color to simulate a grass surface such as polypropylene, ABS (AcrylonitrileButadieneStyrene) or nylon. The upper surface 24 may also be textured to simulate putting green grass.

The apparatus for golf putting practice may also be made of stamped and drawn metal as would be done in the standard manner by someone skilled in the art and the upper surface 24 may be coated in such a manner as to simulate a putting green surface.

Operation

The manner of using the apparatus for golf putting practice 10 is to remove one of the floor mounted vent registers 12 in an office or home and replace it with the apparatus for golf putting practice 10, inserting the apparatus for golf putting practice 10 deep enough into the HVAC outlet opening (not shown) such that the top surface 24 is parallel with the top of the floor covering carpet (not shown). This assures a smooth transition between the carpet and the upper surface 24, allowing a putted golf ball to roll unimpeded toward the golf cup 26.

As in a regular putting contest, golfers wanting to practice their putting may stand at varying distance from the apparatus for golf putting practice and strike regulation golf balls (not shown) with a regular golf putter (not shown) in the direction of the golf cup 26, suspended below the upper surface 24.

The apparatus for golf putting practice may be removed and stored easily and the original vent register 12 reinstalled when the practice activity is completed. However, this is not necessary as the apparatus for golf putting practice 10 is unobtrusive and contains sufficient openings for air flow as to not disrupt the heating or cooling of the room in which it is installed.

The two golf cup embodiment as shown in FIG. 3A and the single cup embodiment as shown in FIG. 3B are utilized in the same manner as the preferred embodiment just described. The second golf cup 44 shown in FIG. 3A being disposed adjacent to the first golf cup 26 can be used either by a second golfer or to give the single golfer two different golf cups to putt towards on slightly different lines.

Ramification and Scope

Accordingly, the reader will see that the apparatus for golf putting practice provides:

(a) an apparatus for golf putting practice that is small, compact, and unobtrusive when installed in an office or home;

(b) an apparatus for golf putting practice in which the golf cup is sized to meet United States Golf Association (USGA) regulations;

(c) an apparatus for golf putting practice that disposes the golf cup below floor level;

(d) an apparatus for golf putting practice which duplicates the unfettered nature of an actual putt;

(e) an apparatus for golf putting practice that replicates the sound and feel of making a putt in a USGA regulation golf cup; and (f) an apparatus for golf putting practice that utilizes the existing floor covering as the putting surface with no additional mats or tracks.

While I have explained my invention in detail with the aid of exemplary embodiment thereof, it will be understood that the invention is not limited to the specific constructional details shown and described by way of example, which may be departed from without departing from the scope and spirit of the invention.

I claim:

1. An apparatus for golf putting practice that will enable a golfer to practice putting in a home or office which is mounted in place of a standard floor mounted heater and ventilation air conditioning register in a heater and ventilation air conditioning system outlet for said home or office; the apparatus including:

a rectangular shaped upper surface that is larger than the dimensions of said heater and ventilation air conditioning outlet;

a lower wall which extends far enough below said upper surface and inset from the perimeter of said rectangular upper surface a distance that enables insertion of said lower wall into said outlet of the heater and ventilation air conditioning system and supports a bottom of a golf cup;

an irregular shaped opening in said upper surface forming a simulated hazard wherein said irregular shaped opening is smaller than the distance between opposing sides of said lower wall;

a plurality of stationary vanes running beneath said irregularly shaped opening with said stationary vanes attached perpendicularly to opposing sides of said lower walls transverse to the long axis of said rectangular shaped upper surface;

a United States Golf Association regulation sized golf cup suspended beneath a matching diameter opening in said upper surface, disposed adjacent to said simulated hazard and centered between said opposing lower walls along the long axis of said upper surface, which is formed by two cup walls of said golf cup extending from the under side of said upper surface to said bottom of the golf cup and extending on a matching radius between the intersections of said opposing lower walls and the matching radius of said cup walls of said golf cup, supporting said bottom of golf cup with either side of said bottom of golf cup truncated at the cord created by the intersection of the diameter of said bottom of golf cup and said opposing lower walls, with said bottom of the golf cup having a plurality of apertures which enable air flow from said heater and ventilation air conditioning system through said bottom of golf cup.

2. The apparatus of claim 1 wherein said apparatus is formed as an integral molded piece from a standard injection grade thermoplastic material which is green in color and said upper surface is textured, simulating a closely sheared grass surface.

3. The apparatus of claim 1 wherein said apparatus is formed as a stamped and drawn sheet metal part with said upper surface coated in such a manner as to simulate a putting green surface.

4. The apparatus of claim 1 including:

a pin with a flag mounted to a top section of the pin;

a pin and flag mounting boss on said upper surface, disposed between said golf cup and said simulated hazard in the area between the perimeter of said upper surface and the lower wall, extending up from said upper surface a sufficient height to enable inserting said pin and flag.

* * * * *